US011022295B2

(12) United States Patent
Park

(10) Patent No.: US 11,022,295 B2
(45) Date of Patent: Jun. 1, 2021

(54) ILLUMINATION DEVICE COOLING MODULE AND COOLING DEVICE INCLUDING SAME

(71) Applicant: Magnatech Co., Ltd, Jeollanam-do (KR)

(72) Inventor: Jun Pyo Park, Gwangju (KR)

(73) Assignee: Magnatech Co., Ltd, Jeollanamo-do (KR)

( * ) Notice: Subject to any disclaimer, the term of this patent is extended or adjusted under 35 U.S.C. 154(b) by 245 days.

(21) Appl. No.: 16/305,890

(22) PCT Filed: Dec. 4, 2017

(86) PCT No.: PCT/KR2017/014055

§ 371 (c)(1),
(2) Date: Nov. 30, 2018

(87) PCT Pub. No.: WO2018/128278

PCT Pub. Date: Jul. 12, 2018

(65) Prior Publication Data

US 2020/0370743 A1 Nov. 26, 2020

(30) Foreign Application Priority Data

Jan. 6, 2017 (KR) ..... 10-2017-0002318

(51) Int. Cl.
*F21V 29/71* (2015.01)
*F21V 29/51* (2015.01)
(Continued)

(52) U.S. Cl.
CPC ..... *F21V 29/717* (2015.01); *F21V 29/51* (2015.01); *F21V 29/745* (2015.01); *F21Y 2105/18* (2016.08); *F21Y 2115/10* (2016.08)

(58) Field of Classification Search
CPC .... F21Y 2115/10; F21V 29/71; F21V 29/717; F21V 29/51
See application file for complete search history.

(56) References Cited

U.S. PATENT DOCUMENTS

2008/0074881 A1* 3/2008 Liaw ..... F21V 29/83 362/294
2012/0033419 A1 11/2012 Kim et al.
2013/0314914 A1* 11/2013 Kim ..... F28F 1/325 362/235

FOREIGN PATENT DOCUMENTS

KR 10-2011-0116559 A 10/2011
KR 10-2012-0013880 A 2/2012
(Continued)

OTHER PUBLICATIONS

Machine Translation of KR 10-1376110 (Year: 2014).*
International Search Report for PCT/KR2017/014055 dated Mar. 18, 2018 from Korean Intellectual Property Office.

*Primary Examiner* — Robert J May
(74) *Attorney, Agent, or Firm* — Revolution IP, PLLC

(57) ABSTRACT

A cooling module for illumination device, includes: a substrate contacting a heat-generating illumination part at a lower part thereof and having an insertion groove formed on the upper surface thereof; a heat pipe which radiates the heat generated from the illumination part and includes a horizontal part inserted into the insertion groove and a vertical part vertically bent from the horizontal part and extending in a longitudinal direction; and a heat radiating plate laminated on and coupled to the vertical part of the heat pipe to promote heat radiation of the heat pipe, and including a coupling part coupled to the heat pipe, an inner fin part cut inward from the coupling part and formed to be twisted by
(Continued)

a predetermined angle, and an outer fin part cut outward from the coupling part and formed to be twisted by a predetermined angle.

7 Claims, 8 Drawing Sheets

(51) Int. Cl.

| | |
|---|---|
| ***F21V 29/74*** | (2015.01) |
| *F21Y 105/18* | (2016.01) |
| *F21Y 115/10* | (2016.01) |

(56) References Cited

FOREIGN PATENT DOCUMENTS

| | | | |
|---|---|---|---|
| KR | 10-1376110 | B1 | 3/2014 |
| KR | 10-2015-0128313 | A | 11/2015 |
| KR | 10-2016-0089635 | A | 7/2016 |

* cited by examiner

[FIG. 1]
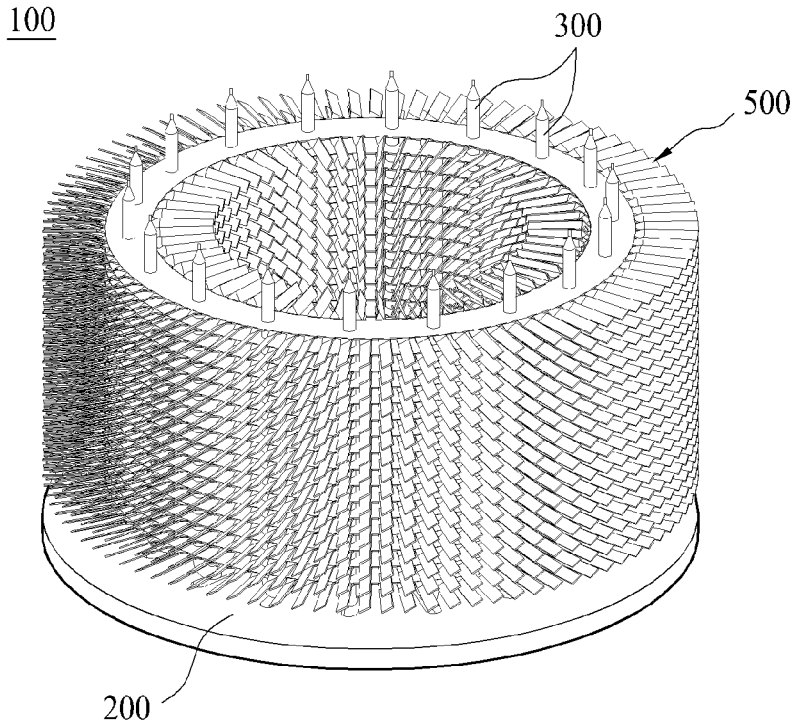

[FIG. 2]
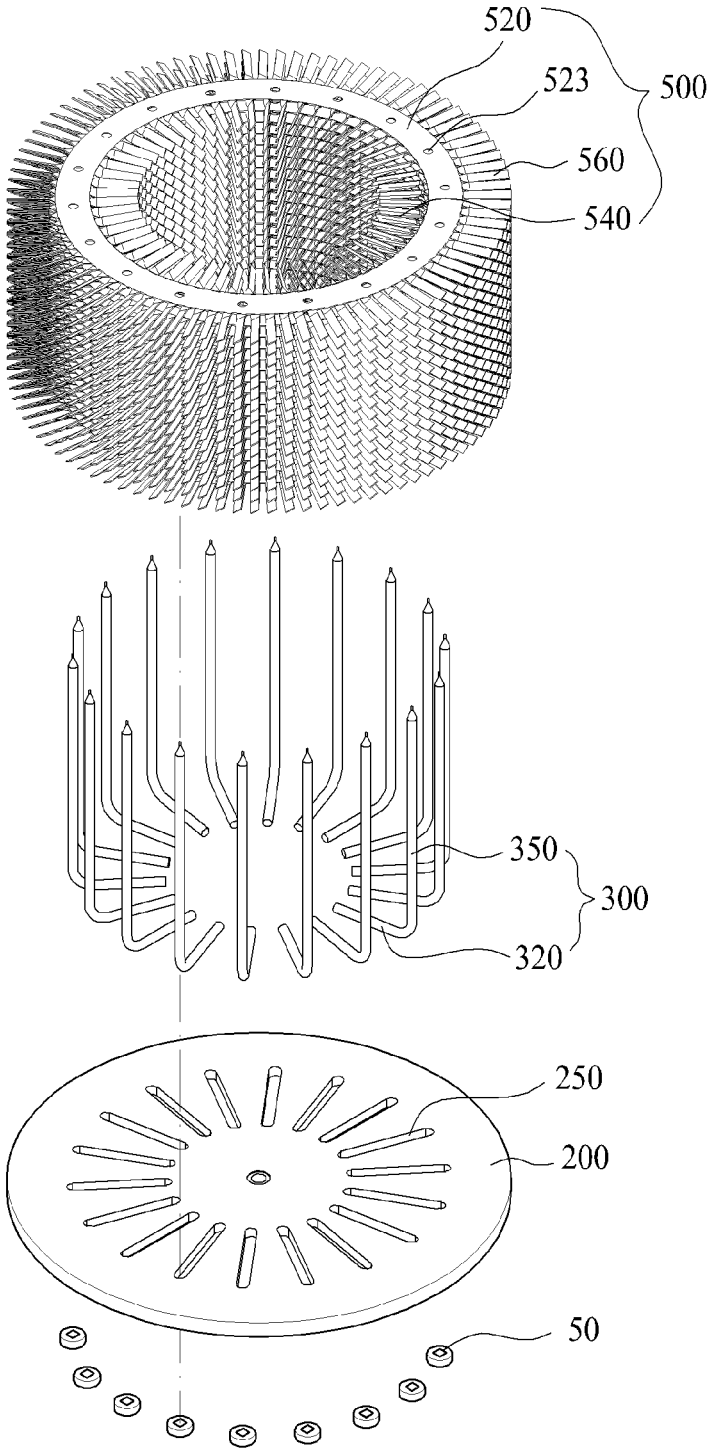

[FIG. 3]
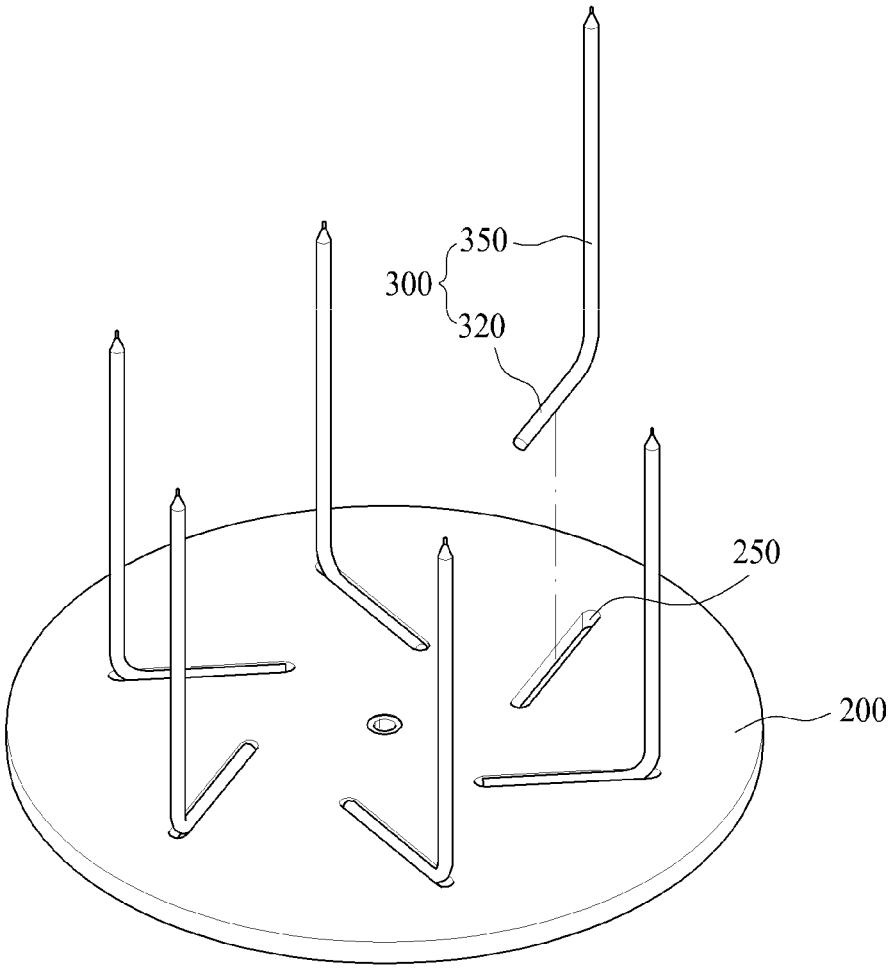

[FIG. 4]
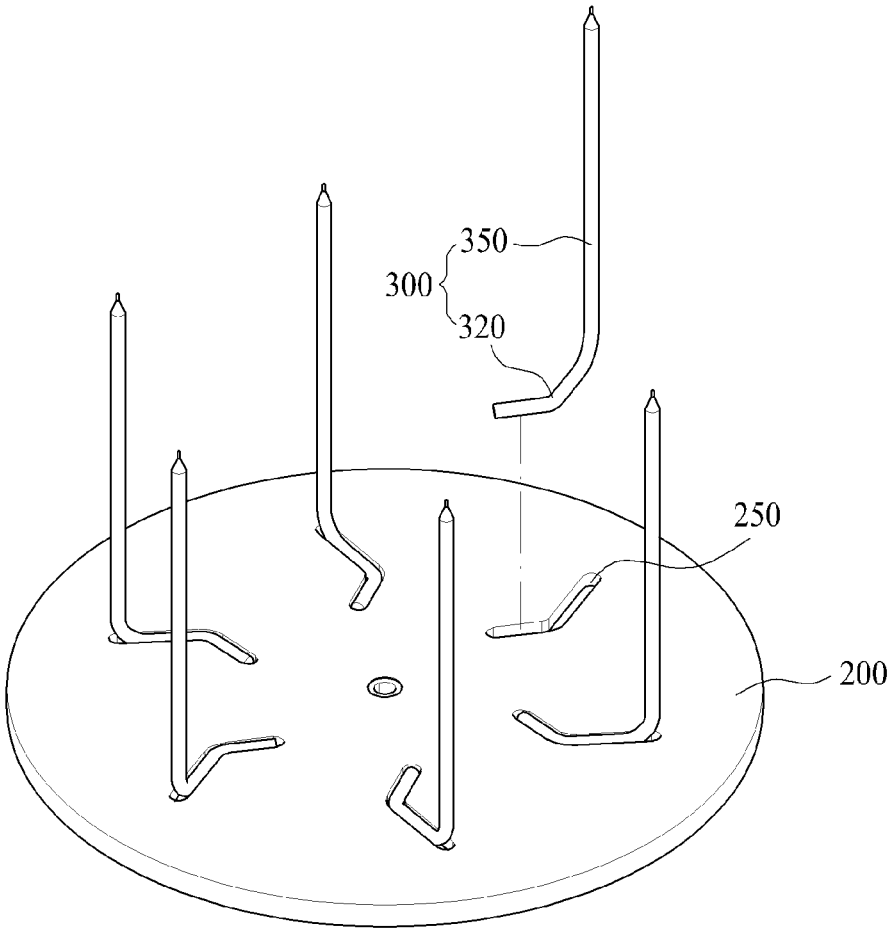

[FIG. 5]
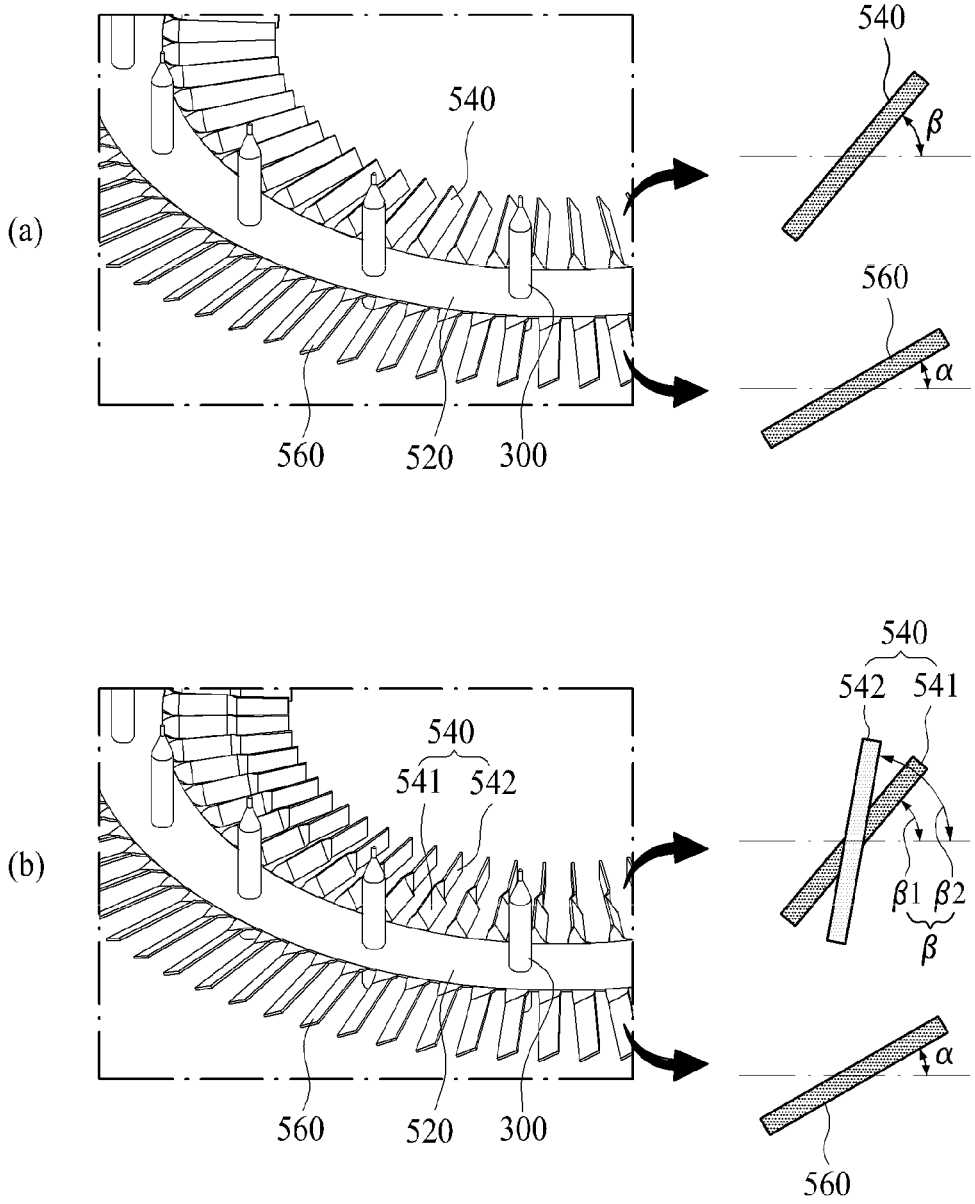

[FIG. 6]
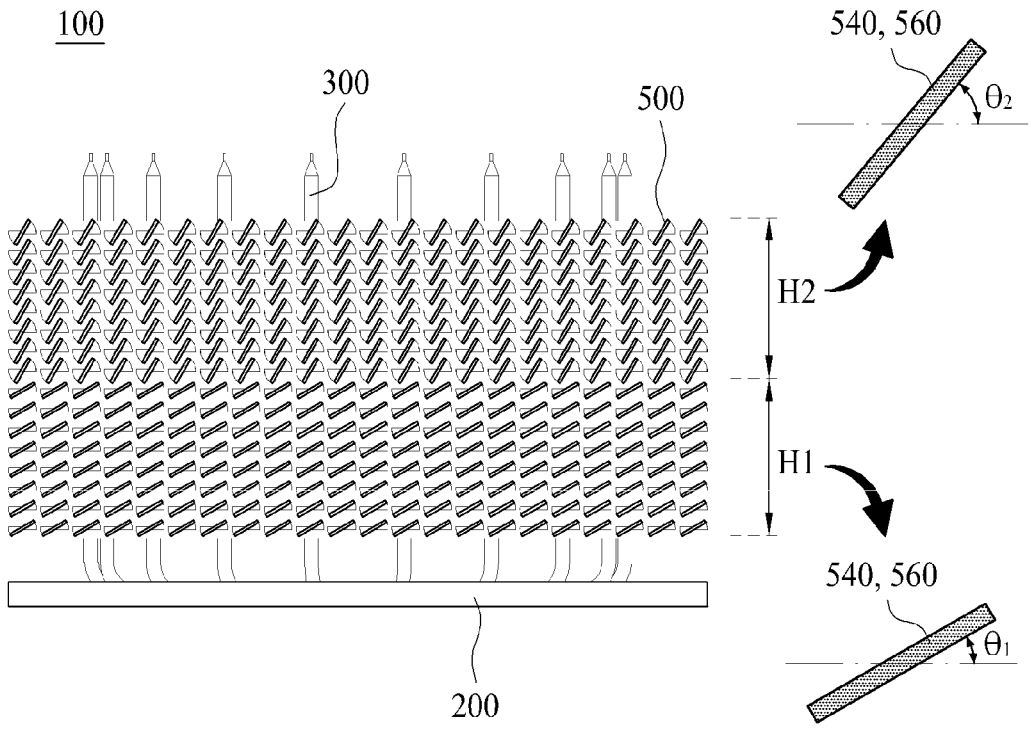

[FIG. 7]
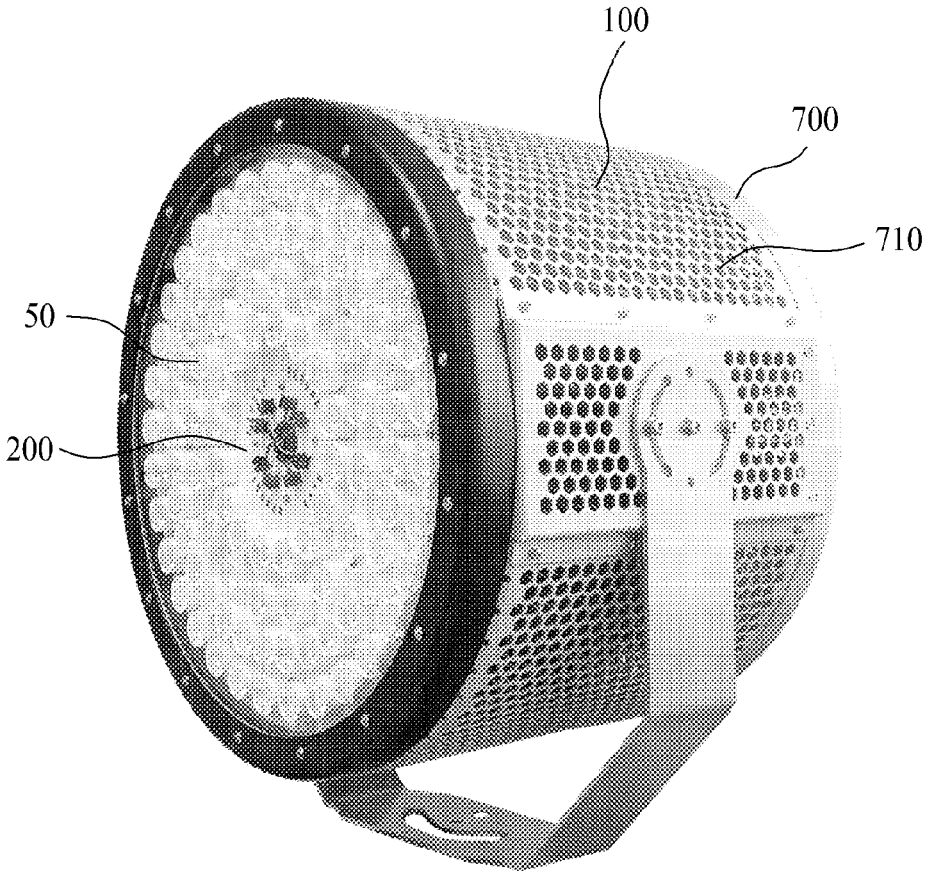

[FIG. 8]
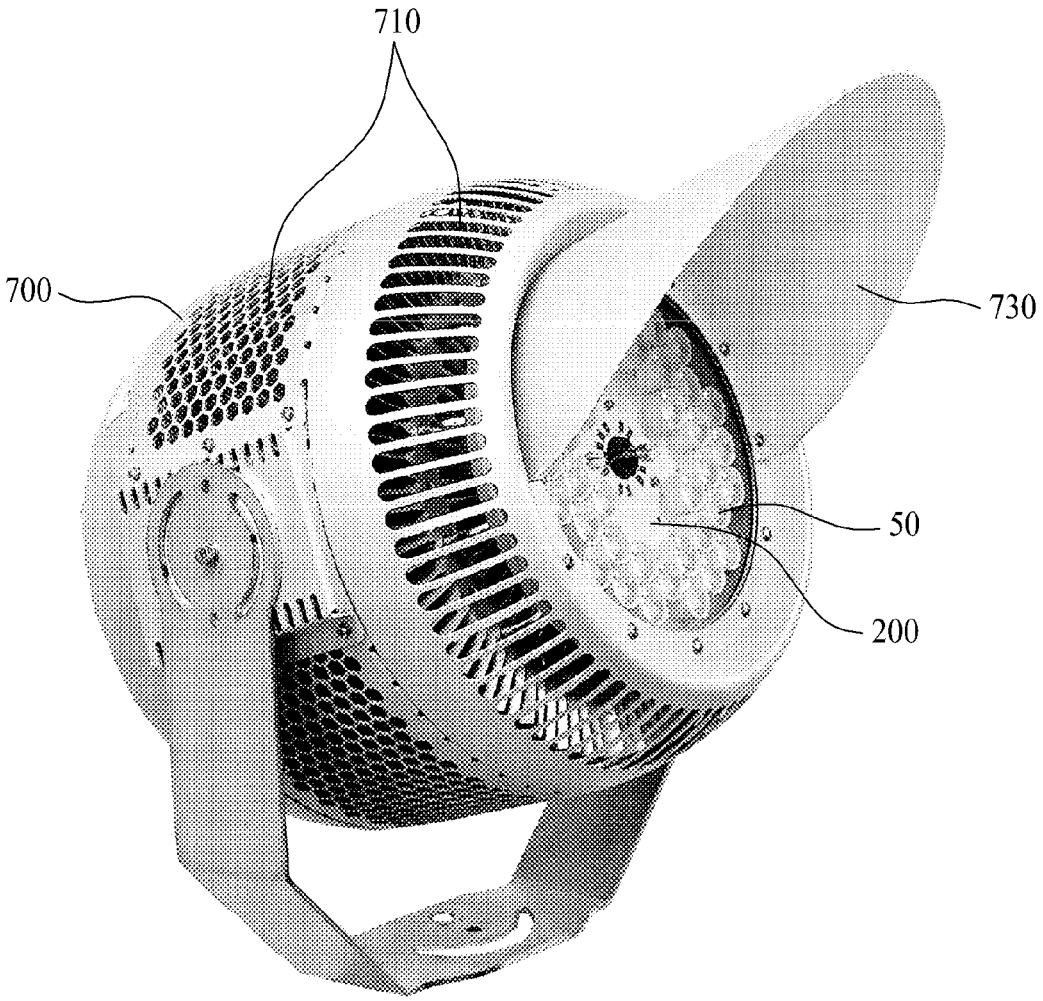

ILLUMINATION DEVICE COOLING MODULE AND COOLING DEVICE INCLUDING SAME

TECHNICAL FIELD

The present invention relates to a cooling module for illumination device and a cooling device including the same, and more particularly, to a cooling module for illumination device that radiates heat generated from an illumination part and a cooling device including the same.

BACKGROUND ART

Most of the power supplied to a LED light is converted into thermal energy, and accordingly, the increase of temperature causes the decrease of light output and the wavelength shift, and the lifetime is drastically reduced.

A heat pipe uses the principle that an evaporative liquid is injected into a closed pipe, evaporation of the liquid occurs, when one end of the pipe is heated, and condensation occurs at the other end of the pipe to dissipate heat. This can minimize the thermal resistance generated in a heat exchange and can increase a cooling effect even by a small temperature difference.

In addition, a device for increasing a cooling efficiency by combining a plurality of heat radiating plates with the heat pipe is also provided.

However, a cooling device for LED illumination according to the above related art is not able to induce a heat of high temperature to the outside of the cooling device smoothly, and thus the cooling efficiency is low.

Therefore, a method for solving such problems is required.

DISCLOSURE

Technical Problem

The present invention has been made in view of the above problems, and provides a cooling module which comprises a substrate, a heat pipe, and a heat radiating plate, when one side of the heat pipe inserted into the substrate is deflected toward the center of the substrate to increase a heat conductivity flowing from the substrate to the heat pipe.

The inner and outer fin parts of a second height portion are twisted at a relatively larger angle than the inner and outer fin parts of a first height portion so that the inner and outer fin parts of the first height portion promote heat radiation to the side, and the inner and outer fin parts of the second height portion promote heat radiation to the upper side.

By twisting the inner fin part at a relatively larger angle than the outer fin part, the outer fin part promotes heat radiation to the side, and the inner fin part promotes heat radiation in the upward tilting direction.

The problems of the present application are not limited to the above-mentioned problems, and other problems not mentioned can be clearly understood by those skilled in the art from the following description.

Technical Solution

In an aspect, there is provided a cooling module for illumination device, the cooling module including: a substrate contacting a heat-generating illumination part at a lower part thereof and having an insertion groove formed on the upper surface thereof; a heat pipe which radiates the heat generated from the illumination part and includes a horizontal part inserted into the insertion groove and a vertical part vertically bent from the horizontal part and extending in a longitudinal direction; and a heat radiating plate laminated on and coupled to the vertical part of the heat pipe to promote heat radiation of the heat pipe, and including a coupling part coupled to the heat pipe, an inner fin part cut inward from the coupling part and formed to be twisted by a predetermined angle, and an outer fin part cut outward from the coupling part and formed to be twisted by a predetermined angle.

The insertion groove and the horizontal part of the heat pipe are formed in a longitudinal direction toward a center of the substrate respectively, and have one side formed to be biased and inserted while progressing toward the center of the substrate.

The insertion groove and the horizontal part of the heat pipe are formed to be bent at least once. The inner and outer fin parts are divided into a first height portion having a predetermined height from a bottom and a second height portion having a height from the first height to a top, wherein the inner and outer fin parts of the second height portion are formed to be twisted by an angle relatively larger than the inner and outer fin parts of the first height portion, wherein the inner and outer fin parts of the first height portion promote heat radiation to a lateral side and the inner and outer fin parts of the second height portion promote heat radiation upward. The inner fin part is formed to be twisted by a relatively larger angle than the outer fin part, wherein the outer fin part promotes heat radiation to a lateral side and the inner fin part promotes heat radiation in an upward tilt direction.

The inner fin part comprises a first inner fin part adjacent to the coupling part and a second inner fin part extending from the first inner fin part, wherein the second inner fin part is formed to be twisted by a relatively larger angle than the first inner fin part, wherein the first inner fin part promotes heat radiation in an upward tilt direction and the second inner fin part promotes heat radiation upward.

In another aspect, there is provided a cooling device having a cooling module for illumination device, the cooling device including: the above mentioned cooling module; an illumination part attached to a lower portion of the cooling module; and a case which accommodates the cooling module and the illumination part, and has a vent hole.

The case further comprises a visor so as to control a path of light emitted from the illumination part.

Advantageous Effects

In order to solve the above-described problems, a cooling module for illumination device and a cooling device including the same have the following effects.

First, one side of the heat pipe is formed to be biased while progressing toward a center of the substrate, so that the thermal conductivity from the substrate to the heat pipe can be increased.

Second, the inner and outer fin parts of the second height portion are formed to be twisted by a relatively larger angle than the inner and outer fin parts of the first height portion, so that the inner and outer fin parts of the first height portion promote heat radiation to the lateral side, and the inner and outer fin parts of the second height portion promote heat radiation to the upper side.

Thirdly, the inner fin part is formed to be twisted by a relatively larger angle than the outer fin part, so that the outer fin part guides the inflow of the outside air to the lateral side and the inner fin part guides the inflow of the outside air in the upward tilt direction, thereby promoting heat radiation.

Fourthly, the second inner fin part is formed to be twisted by a relatively larger angle than the first inner fin part, so that the first inner fin part guides the flow of the introduced air in the upward tilt direction and the second inner fin part guides in the upward direction, thereby promoting heat radiation.

The effects of the present invention are not limited to the effects mentioned above, and other effects not mentioned can be clearly understood by those skilled in the art from the description of the claims.

DESCRIPTION OF DRAWINGS

The objects, features and advantages of the present invention will be more apparent from the following detailed description in conjunction with the accompanying drawings, in which:

FIG. 1 is a view illustrating a cooling module according to a first embodiment of the present invention;

FIG. 2 is an exploded perspective view of a cooling module according to a first embodiment of the present invention;

FIG. 3 and FIG. 4 are views showing a substrate and a heat pipe of a cooling module according to a first embodiment of the present invention;

FIG. 5 and FIG. 6 are views showing a heat radiating plate of a cooling module according to a first embodiment of the present invention; and FIG. 7 and FIG. 8 are views showing a cooling device according to a first embodiment of the present invention.

MODE FOR INVENTION

Hereinafter, preferred embodiments of the present invention will be described with reference to the accompanying drawings. In describing the present embodiment, the same designations and the same reference numerals are used for the same components, and further description thereof will be omitted.

Referring to FIGS. 1 and 2, a cooling module 100 for illumination device according to the present invention is roughly composed of a substrate 200, a heat pipe 300, and a heat radiating plate 500.

The substrate 200 is preferably a circular or polygonal plate-shaped metal material having good thermal conductivity, and an illumination part 50, such as a plurality of LED elements, which generates a high heat is installed and in contact with a lower portion of the substrate 200.

On the upper surface of the substrate 200, a plurality of insertion grooves 250 having a diameter corresponding to a diameter of the heat pipe 300 described later are formed.

The heat pipe 300 is configured in such a manner that volatile fluid is injected into a closed container, and is a generally used heat conduction means in which heat is transferred to the other end of the heat pipe 300 at a high speed when heat is applied to one end of the heat pipe 300.

The heat pipe 300 according to the present embodiment includes a horizontal part 320 inserted into the insertion groove 250 formed on the upper surface of the substrate 200, and a vertical part 350 bent in the vertical direction from the horizontal part 320 and extending in the longitudinal direction.

Accordingly, the heat generated from the illumination part 50 is conducted to the substrate 200, and the heat pipe 300 installed on the upper surface of the substrate 200 serves to dissipate heat generated from the illumination part 50.

Referring to FIG. 2, the insertion groove 250 formed in the substrate 200 and the horizontal part 320 of the heat pipe 300 inserted into the insertion groove 250 are formed in the longitudinal direction toward the center of the substrate 200, respectively.

When the illumination part 50 is actually operated, the temperature of a central portion is much higher than that of the edge of the substrate 200. Therefore, as shown in FIG. 2, the horizontal parts 320 of the plurality of heat pipes 300 are disposed such that their adjacent distances become smaller while progressing toward the central portion.

That is, the horizontal part 320 of the heat pipe 300 is installed to be concentrated while progressing toward the central portion of the substrate 200, so that the high temperature heat conducted from the central portion of the substrate 200 can be conducted easily to the vertical part 350 from the horizontal part 320 of the heat pipe 300.

Referring to FIG. 3, another embodiment of the insertion groove 250 formed in the substrate 200 and the horizontal part 320 of the heat pipe 300 inserted into the insertion groove 250 is shown.

As shown in FIG. 3, the insertion groove 250 formed in the substrate 200 is formed in the longitudinal direction toward the central portion of the substrate 200, and one side of the horizontal part 320 is formed to be biased while progressing toward the central portion of the substrate 200.

Then, the horizontal part 320 of the heat pipe 300 is inserted into the insertion groove 250 formed to be biased.

As described above, when the insertion groove 250 is formed and the horizontal part 320 of the heat pipe 300 is inserted into the insertion groove 250, if the number of the heat pipes 300 of FIG. 3 corresponds to the number of heat pipes of FIG. 2, when a virtual concentric circle is drawn based on the central portion of the substrate, the area of the horizontal part 320 of the heat pipe 300 contacting the concentric circle is more increased than in the above described embodiment of FIG. 2.

That is, by increasing the area of the horizontal part 320 of the heat pipe 300 contacting the concentric area adjacent to the central portion of the substrate 200 having the highest temperature, the heat can be more easily conducted from the horizontal part 320 of the heat pipe 300 to the vertical part 350.

In addition, as shown in FIG. 4, the insertion groove 250 formed in the substrate 200 and the horizontal part 320 of the heat pipe 300 inserted into the insertion groove 250 may be formed to be bent at least once.

This also increases the area of the horizontal part 320 of the heat pipe 300 contacting an area of the concentric circle adjacent to the central portion of the substrate 200 so that heat can be easily conducted from the horizontal part 320 of the heat pipe 300 to the vertical part 350.

Referring to FIG. 2, the plurality of heat radiating plates 500 are laminated on the vertical part 350 of the heat pipe 300 to promote heat radiation of the heat pipe 300. The heat radiating plate 500 includes a coupling part 520, an inner fin part 540, and an outer fin part 560.

The coupling part 520 is in the form of a flat plate, and a plurality of coupling holes 523 are formed in the coupling part 520. The vertical part 350 of the heat pipe 300 is inserted into and coupled to the coupling hole 523.

The inner fin part 540 is cut inward from the coupling part 520 and formed to be twisted by a predetermined angle. That is, the inner fin part 540 is formed by cutting the inner portion of the coupling part 520 by a predetermined length, and by twisting the cut surface by a predetermined angle.

The outer fin part 560 is cut outward from the coupling part 520 and formed to be twisted by a predetermined angle. That is, the outer fin part 560 is formed by cutting the outer portion of the coupling part 520 by a predetermined length, and by twisting the cut surface by a predetermined angle.

Here, as shown in the drawing, the inner fin part 540 is formed to be twisted in a counterclockwise direction as viewed from the inside, and the outer fin part 560 is formed to be twisted in a counterclockwise direction as viewed from the outside. It is obvious that the direction of twisting the inner and outer fin parts 540 and 560 can be selected separately or together in a clockwise or counterclockwise direction.

Therefore, since the illumination part 50, the substrate 200, the heat pipe 300, and the heat radiating plate 500 are connected to each other, the heat generated from the illumination part 50 is conducted to the substrate 200, conducted to the vertical part 350 from the horizontal part 320 of the heat pipe 300, and is radiated through the heat radiating plate 500 connected to the vertical part 350.

Referring to FIG. 5A, the inner fin part 540 is formed to be twisted by a relatively larger angle than the outer fin part 560.

That is, the angle (β) at which the inner fin part 540 is tilted based on a virtual horizontal axis is relatively larger than the angle (α) at which the outer fin part 560 is tilted based on the virtual horizontal axis.

With the above configuration, the outer fin part 560 guides the flow of heat and the inflow of outside air to the side to promote heat radiation, and the inner fin part 540 guides the flow of heat and the inflow of outside air in the upward tilting direction to promote heat radiation.

The inner fin part 540 is exposed to the outside air, and the inner fin part 540 is positioned on an inner space formed by the substrate 200 in which heat of high temperature is generated and the inner fin part 540, so that the temperature of the inner fin part 540 is relatively higher than that of the outer fin part 560.

Accordingly, the twist angle (α) of the outer fin part 560 is formed to be relatively small to guide the outside air introduced horizontally into the inner space formed by the substrate 200 and the inner fin part 540, and the twist angle (β) of the inner fin part 540 is formed to be relatively large to guide the flow of the introduced air to the upper portion of the heat radiating plate 500 in the upward tilting direction to promote the heat radiation.

Referring to FIG. 5B, another embodiment of forming the twist angle of the inner fin part 540 is shown.

The inner fin part 540 includes a first inner fin part 541 formed adjacent to the inside, i.e., the coupling part 520 and a second inner fin part 542 extended from the outer side i.e., the first inner fin part 541.

The second inner fin part 542 is formed to be twisted by a relatively larger angle than the first inner fin part 541. That is, the angle (β2) at which the second inner fin part 542 is tilted based on a virtual horizontal axis is relatively larger than the angle (β1) at which the first inner fin part 541 is tilted based on the virtual horizontal axis.

Accordingly, the outer fin part 560 forms the twist angle (α) to be relatively small to guide the outside air introduced horizontally into an inner space formed by the substrate 200 and the inner fin part 540, and forms the twist angle (β1) of the first inner fin part 541 to be relatively larger than the twist angle (α) of the outer fin part 560 to guide the flow of the introduced air to the upward tilting direction. Further, the twist angle (β2) of the second inner fin part 542 is formed to be relatively larger than the twist angle (β1) of the first inner fin part 541 to guide the flow of the introduced air to the upper portion of the heat radiating plate 500 in the upward direction to promote the heat radiation.

Referring to FIG. 6, the inner fin part 540 and the outer fin part 560 may be divided into a first height portion H1 having a predetermined height from the bottom and a second height portion H2 having a height from the first height H1 to the top.

The inner and outer fin parts 540 and 560 of the second height portion H2 are formed to be twisted by an angle relatively larger than the inner and outer fin parts 540 and 560 of the first height portion H1.

As described above, when the actual illumination part 50 is operated, the temperature of the central portion of the substrate 200 is much higher than that of the edge of the substrate 200, and when the laminated heat radiating plate 500 is viewed based on the vertical direction, the first height portion H1, which is a lower area, adjacent to the substrate 200 is relatively higher in temperature than the second height portion H2 which is an upper area.

Accordingly, the tilt angle θ1 of the inner and outer fin parts 540 and 560 of the first height portion H1 is formed to be relatively small to guide the outside air introduced horizontally to the inner space formed by the substrate 200 and the inner fin part 540. The twist angle η2 of the inner and outer fin parts 540 and 560 of the second height portion H2 is formed to be relatively large to guide the heat of high temperature of the first height portion H1 to the upper portion of the heat radiating plate 500, which is the upward direction, to promote heat radiation.

In addition to the twist angle of the first height portion H1 and the second height portion H2 shown in FIG. 6, as shown in FIG. 5A, the twist angle (β) of the inner fin part 540 is formed to be relatively larger than the twist angle (α) of the outer fin part 560. Further, as shown in FIG. 5B, the twist angle (β2) of the second inner fin part 542 is formed to be relatively larger than the twist angle (β1) of the first inner fin part 541 to enhance the heat radiation effect.

Referring to FIG. 7 and FIG. 8, a cooling device having a cooling module for illumination device according to the present invention includes a cooling module 100, an illumination part 50, and a case 700. The cooling module 100 includes the cooling module 100 of all embodiments described in FIGS. 1 to 6.

A plurality of illumination parts 50 are installed to be in contact with the lower portion of the substrate 200. Accordingly, as described above, the heat generated from the illumination part 50 is radiated through the substrate 200, the heat pipe 300, and the heat radiating plate 500.

The case 700 accommodates the cooling module 100 and the illumination part 50. The case 700 is provided with a plurality of vent holes 710 so that outside air can be smoothly introduced.

As shown in FIG. 7, the vent hole 710 may be formed only on the outer circumferential surface of the case 700. Alternatively, as shown in FIG. 8, the vent hole 710 may be formed on the outer circumferential surface of the case 700 and a lower area.

In addition, referring to FIG. 8, a visor 730 is further provided in the lower outer circumferential surface of the case 700 adjacent to the illumination part 50.

The visor 730 serves to control a path direction of light emitted from the illumination part 50.

As shown in the drawing, in the form of a brim, the visor 730 may be installed only in the upper portion of the outer circumferential surface of the lower portion of the case 700, or may be installed on the lateral side or lower portion of the outer circumferential surface.

In addition, the visor 730 may be formed in a cylindrical shape or a trumpet shape to be installed on the entire outer circumferential surface of the lower portion of the case 700.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

The invention claimed is:

1. A cooling module for illumination device, the cooling module comprising:

a substrate contacting a heat-generating illumination part at a lower part thereof and having an insertion groove formed on the upper surface thereof;

a heat pipe which radiates the heat generated from the illumination part and includes a horizontal part inserted into the insertion groove and a vertical part vertically bent from the horizontal part and extending in a longitudinal direction; and a heat radiating plate laminated on and coupled to the vertical part of the heat pipe to promote heat radiation of the heat pipe, and including a coupling part coupled to the heat pipe, an inner fin part cut inward from the coupling part and formed to be twisted by a predetermined angle, and an outer fin part cut outward from the coupling part and formed to be twisted by a predetermined angle, wherein the inner and outer fin parts are divided into a first height portion having a predetermined height from a bottom and a second height portion having a height from the first height to a top, wherein the inner and outer fin parts of the second height portion are formed to be twisted by an angle relatively larger than the inner and outer fin parts of the first height portion, wherein the inner and outer fin parts of the first height portion promote heat radiation to a lateral side and the inner and outer fin parts of the second height portion promote heat radiation upward.

2. The cooling module of claim 1, wherein the insertion groove and the horizontal part of the heat pipe are formed in a longitudinal direction toward a center of the substrate respectively, and have one side formed to be biased and inserted while progressing toward the center of the substrate.

3. The cooling module of claim 2, wherein the insertion groove and the horizontal part of the heat pipe are formed to be bent at least once.

4. A cooling device having a cooling module for illumination device, the cooling device comprising:

the cooling module of claim 1;

an illumination part attached to a lower portion of the cooling module; and a case which accommodates the cooling module and the illumination part, and has a vent hole.

5. The cooling device of claim 4, wherein the case further comprises a visor so as to control a path of light emitted from the illumination part.

6. A cooling module for illumination device, the cooling module comprising:

a substrate contacting a heat-generating illumination part at a lower part thereof and having an insertion groove formed on the upper surface thereof;

a heat pipe which radiates the heat generated from the illumination part and includes a horizontal part inserted into the insertion groove and a vertical part vertically bent from the horizontal part and extending in a longitudinal direction; and a heat radiating plate laminated on and coupled to the vertical part of the heat pipe to promote heat radiation of the heat pipe, and including a coupling part coupled to the heat pipe, an inner fin part cut inward from the coupling part and formed to be twisted by a predetermined angle, and an outer fin part cut outward from the coupling part and formed to be twisted by a predetermined angle, wherein the inner fin part is formed to be twisted by a relatively larger angle than the outer fin part, wherein the outer fin part promotes heat radiation to a lateral side and the inner fin part promotes heat radiation in an upward tilt direction.

7. The cooling module of claim 6, wherein the inner fin part comprises a first inner fin part adjacent to the coupling part and a second inner fin part extending from the first inner fin part, wherein the second inner fin part is formed to be twisted by a relatively larger angle than the first inner fin part, wherein the first inner fin part promotes heat radiation in an upward tilt direction and the second inner fin part promotes heat radiation upward.

* * * * *